US007314146B2

(12) United States Patent
Mavin

(10) Patent No.: US 7,314,146 B2
(45) Date of Patent: Jan. 1, 2008

(54) CLOSURE WITH PRESSURE RELEASE SYSTEM

(75) Inventor: Gerry Mavin, Ashington (GB)

(73) Assignee: Portola Packaging Limited, South Yorkshire (GB)

( * ) Notice: Subject to any disclaimer, the term of this patent is extended or adjusted under 35 U.S.C. 154(b) by 0 days.

(21) Appl. No.: 10/338,758

(22) Filed: Jan. 7, 2003

(65) Prior Publication Data

US 2003/0173325 A1 Sep. 18, 2003

(30) Foreign Application Priority Data

Jan. 11, 2002 (GB) ..... 0200614.6

(51) Int. Cl.
*B65D 51/16* (2006.01)
*B65D 41/00* (2006.01)

(52) U.S. Cl. ..... 215/307; 215/270; 215/271; 215/344; 215/354; 215/252; 215/321; 220/366.1

(58) Field of Classification Search ..... 215/270, 215/271, 307, 344, 354, 252, 260, 321; 220/366.1
See application file for complete search history.

(56) References Cited

U.S. PATENT DOCUMENTS 2,965,256 A * 12/1960 Yochem ..... 215/329
3,069,040 A * 12/1962 Corsette ..... 215/318
4,206,852 A * 6/1980 Dunn et al. ..... 215/252
4,346,812 A * 8/1982 Banich, Sr. ..... 215/352
4,489,845 A * 12/1984 Aichinger et al. ..... 215/329
5,275,287 A * 1/1994 Thompson ..... 215/344
5,385,252 A * 1/1995 Hidding et al. ..... 215/230
5,743,420 A * 4/1998 Loffler et al. ..... 215/270
5,785,196 A * 7/1998 Montgomery ..... 215/354
5,803,286 A * 9/1998 Pfefferkorn et al. ..... 215/307
5,871,111 A 2/1999 Pfefferkorn et al.

(Continued)

FOREIGN PATENT DOCUMENTS

DE 8524966 1/1987

(Continued)

*Primary Examiner*—Nathan J. Newhouse
*Assistant Examiner*—James Smalley
(74) *Attorney, Agent, or Firm*—James Hanrath; Adam Sacharoff; Much Shelist

(57) ABSTRACT

There is described a neck structure in combination with a closure. The neck structure defines a neck opening with a cylindrical sealing surface surrounding the neck opening and an external neck surface. The closure comprises a cap formed of resilient material having a top and a downwardly extending skirt portion depending from the top. An annular plug depends from an underside of the top and one or more ribs are formed on an internal surface of the downwardly extending skirt portion. The annular plug and the one or more ribs are arranged concentrically and are dimensioned such that, upon application of the cap to the neck structure, the annular plug projects into the neck opening and engages the cylindrical sealing surface. At the same time the one or more ribs engage the external neck surface. The annular plug is adapted to flex away from the cylindrical sealing surface upon the build up of excess pressure within the closure whereupon circumferentially spaced ends of the or each rib define therebetween a path for the venting of fluid to release the excess pressure.

There is also described a closure for use with a neck structure.

23 Claims, 8 Drawing Sheets

U.S. PATENT DOCUMENTS

| | | | | |
|---|---|---|---|---|
| 5,875,915 | A * | 3/1999 | Bradshaw et al. | 220/319 |
| 6,021,912 | A * | 2/2000 | Hertrampf | 215/344 |
| 6,102,225 | A * | 8/2000 | Lynn | 215/252 |
| 6,330,959 | B1 * | 12/2001 | Dark | 222/153.1 |
| 6,502,710 | B1 * | 1/2003 | Bosl et al. | 215/351 |
| 6,523,710 | B1 * | 2/2003 | Hidding et al. | 215/252 |

FOREIGN PATENT DOCUMENTS

| | | | |
|---|---|---|---|
| EP | 0060218 | A2 | 9/1982 |
| EP | 0464384 | A1 | 1/1992 |
| EP | 575987 | A2 * | 12/1993 |
| EP | 0661218 | A1 | 7/1995 |
| EP | 0982234 | A1 | 3/2000 |
| GB | 0958417 | A | 5/1964 |
| GB | 1150170 | A | 4/1969 |
| GB | 2013635 | A | 8/1979 |
| WO | WO97/34812 | A1 | 9/1997 |
| WO | WO 01/32525 | A1 | 5/2001 |

* cited by examiner

CLOSURE WITH PRESSURE RELEASE SYSTEM

The present invention relates to closures for containers and to closures in combination with neck structures. In particular, the present invention relates to a closure which incorporates a pressure release system which enables a build up of fluid to be vented from a container.

In recent years it has become common to package potable fluids such as milk, water and fruit juices in blow moulded plastics containers which are provided with re-sealable caps. It is also common for the same fluids to be packaged in paperboard cartons provided with moulded plastics neck fitments which once again are closed by re-sealeable caps. The re-sealable caps are typically formed of injection moulded plastics material. In order to achieve market acceptance of these forms of packaging much effort has been put into addressing the problem of leakage. This has lead in recent years to the proposal of a large number of different design of closure. For example, in one design the closure takes the form of a cap comprising a top and a downwardly extending skirt portion which depends from the top. The skirt portion is provided on an inner surface with one or more threads for engagement with one or more complimentary threads provided on an outer surface of a neck provided on the container. The neck may be formed integrally with the container or else may comprise a fitment which is bonded or otherwise joined to the container in order to provide a neck structure. A downwardly depending annular plug is provided on an underside of the top, spaced radially inwardly of the skirt. The plug is dimensioned to engage a rim of the opening defined by the neck so as to form a primary seal. A secondary seal is provided by means of an annular bead or shoulder provided on the cap at or adjacent the intersection of the top and the depending skirt such that, on application of the cap to the neck structure, the bead or shoulder engages an external surface of the neck at a location above the threads. This use of both a primary and a secondary seal is widespread and is regarded as necessary in caps which do not initially incorporate a foil liner in order to achieve the leakage rates demanded by both the supermarkets and the customer. Indeed, the provision of tertiary seals are not unknown while the use of foil liners which are initially bonded to the neck structure to close the opening are increasingly widespread.

It is against this background that a problem has been identified which relates particularly to the packaging of freshly squeezed fruit juices. It has been found that these fruit juices can begin to ferment in warm conditions when, for example, the container is not stored within a refrigerator or when left in a car. Even at room temperature it has been found that the fermentation process can cause a build up of gas within the container with the result that caps have been blown off by the excess pressure. This kind of catastrophic closure failure and the resulting leakage is damaging not only to those goods with which the leaked contents comes into contact but also to the reputation and reliability of the entire packaging process.

What has not been available previously is a closure that provides adequate sealing under normal conditions but which, when subjected to a build up of pressure, will enable fluid to be vented and the sealing characteristics of the closure to be restored.

According to a first aspect of the present invention there is provided a neck structure in combination with a closure, neck structure defining a neck opening, a cylindrical sealing surface surrounding said neck opening, and an external neck surface, and the closure comprising a cap formed of resilient material having a top, a downwardly extending skirt portion depending from said top, an annular plug depending from an underside of said top and one or more ribs formed on an internal surface of said downwardly extending skirt portion, the annular plug and said one or more ribs being arranged concentrically and dimensioned such that, upon application of the cap to the neck structure, the annular plug projects into the neck opening and engages the cylindrical sealing surface and said one or more ribs engage said external neck surface, the annular plug being adapted to flex away from the cylindrical sealing surface upon the build up of excess pressure within the closure whereupon circumferentially spaced ends of the or each rib define therebetween a path for the venting of fluid to relieve said excess pressure.

According to the second aspect of the present invention there is provided a closure for use with a neck structure, the closure comprising a cap formed of resilient material having a top, a downwardly extending skirt portion depending from said top, an annular plug depending from an underside of said top, and one or more ribs formed on an internal surface of said downwardly extending skirt portion, said one or more ribs being arranged concentrically with the annular plug and circumferentially spaced ends of the or each rib defining an arcuate space therebetween.

Although the closure need only be provided with one rib provided that it has an arcuate extent of less than 360° so that its opposite ends are circumferentially spaced and define therebetween a path for the venting of fluid, the closure preferably comprises a plurality of such ribs. The number of ribs may vary. For example, the closure may comprise two ribs each having a circumferential extent of approximately 120° or less thereby defining two paths between the respective pairs of opposite ends through which fluid may escape. Alternatively, a larger number of ribs may be provided for example, three, four, five, six or seven ribs, each being of somewhat lesser circumferentially extent so as to ensure that the circumferentially spaced ends of adjacent ribs define a sufficient arcuate space therebetween to permit the venting of fluid, typically excess gas, that might otherwise build up within the container.

Although, where more than one rib is provided, each rib may have a circumferentially extent of up to approximately 120°, in a currently preferred embodiment the circumferential extent of each rib is very much less and lies within the range of between 3° and 12°. Preferably the ribs are circumferentially spaced at equal angles around the cap.

Advantageously the annular plug is provided with one or more buttresses which are spaced radially inwardly of the annular plug and which merge with both the annular plug and the underside of the top. This serves to provide the annular plug with additional strength and facilitates the return of the plug into engagement with the cylindrical sealing surface once any excess pressure has been relieved. Although a single buttress may be provided, it is preferred that the cap comprise a plurality of buttresses, for example two, three, four, five, six or seven buttresses, each having a circumferential extent of less than 30°. In a currently preferred embodiment the buttresses, like the ribs, have a circumferential extent of between 3° and 12°.

Advantageously the buttresses are circumferentially spaced at equal angles around the annular plug. Furthermore, the buttresses are preferably circumferentially spaced with respect to the ribs. Indeed, in a currently preferred embodiment the buttresses and ribs alternate and are spaced at equal angles around the cap. This serves to maintain the rotational symmetry of the cap and provides both uniform sealing and uniform venting characteristics.

Advantageously the plug is provided at an end remote from the underside of the top with a radially outer bevelled, radiused or chamfered surface that extends generally downwardly and radially inwardly. This not only serves to aid the insertion of the annular plug into the neck opening but also facilitates the flexing away of the annular plug from the cylindrical sealing surface upon the build up of excess pressure within the container.

Advantageously, the cap is formed of plastics material selected from the list comprising linear low density polyethelene, LDPE, MDPE, HDPE or copolymer polypropylene.

An embodiment of the present invention will now be described by way of example with reference to the accompanying drawings in which.

Figure 7C:
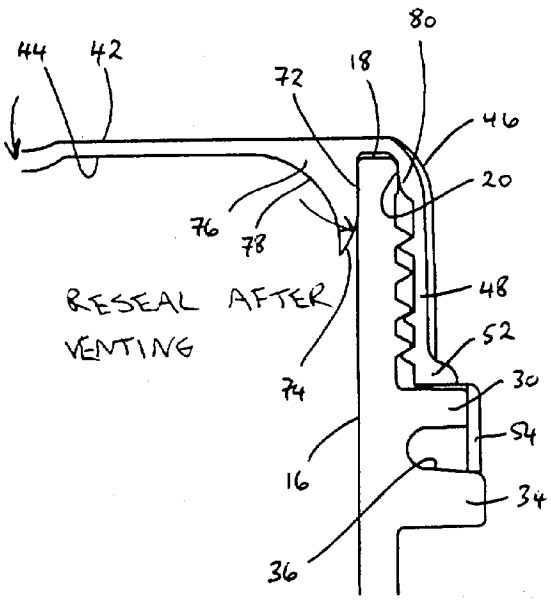
Figure 7B:
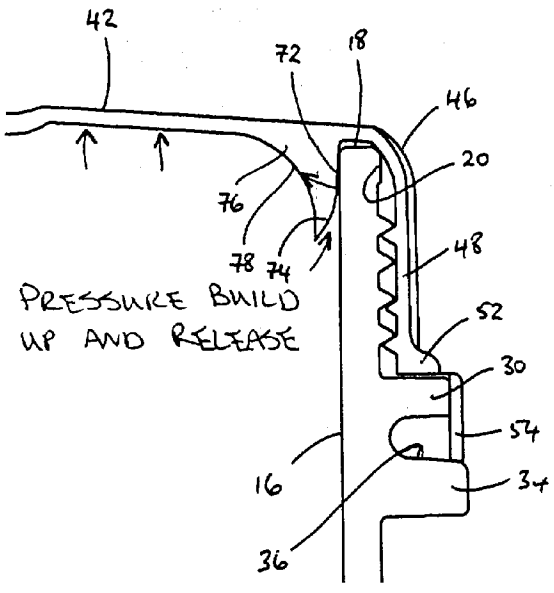
Figure 7A:
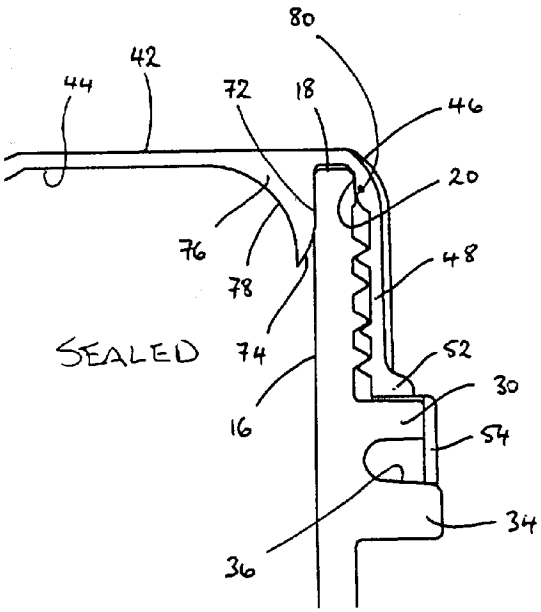
Figure 8:
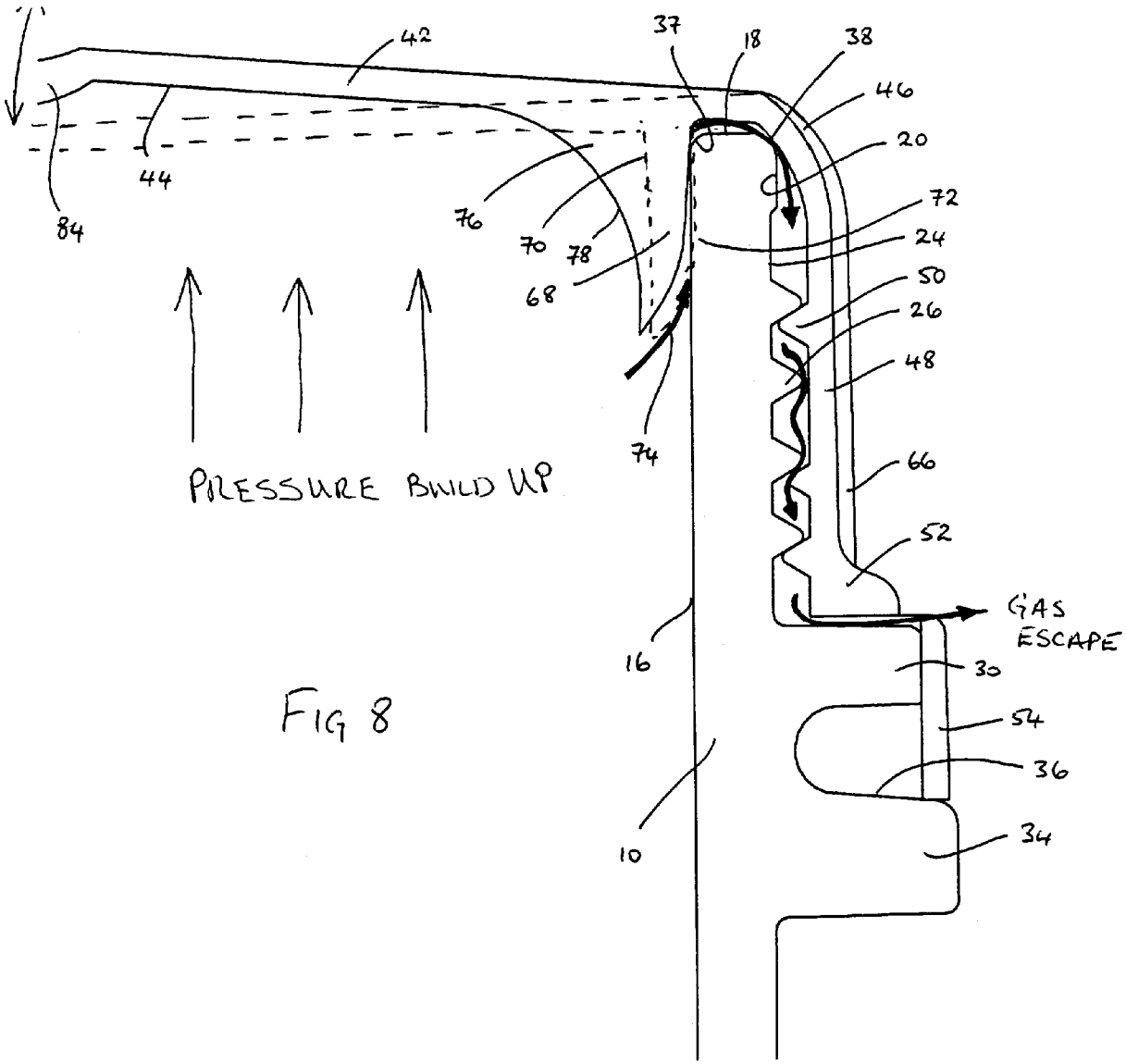

FIGS. 7*a*–7*c* are partial cross-sectional views of the cap and container neck and illustrate, respectively, the cap and container neck prior to the build up of excess gas pressure within the container; the doming of the cap and the flexing of the annular plug away from the container neck as a result of a pressure build up within the container; and the return of the cap to its normal sealing position once the excess gas has been vented to the atmosphere; and FIG. 8 is an enlarged cross-sectional view of the cap and neck showing the cap domed upwards as a result of the build up of excess pressure within the container and the annular plug flexing away from the container neck.

Figure 1:
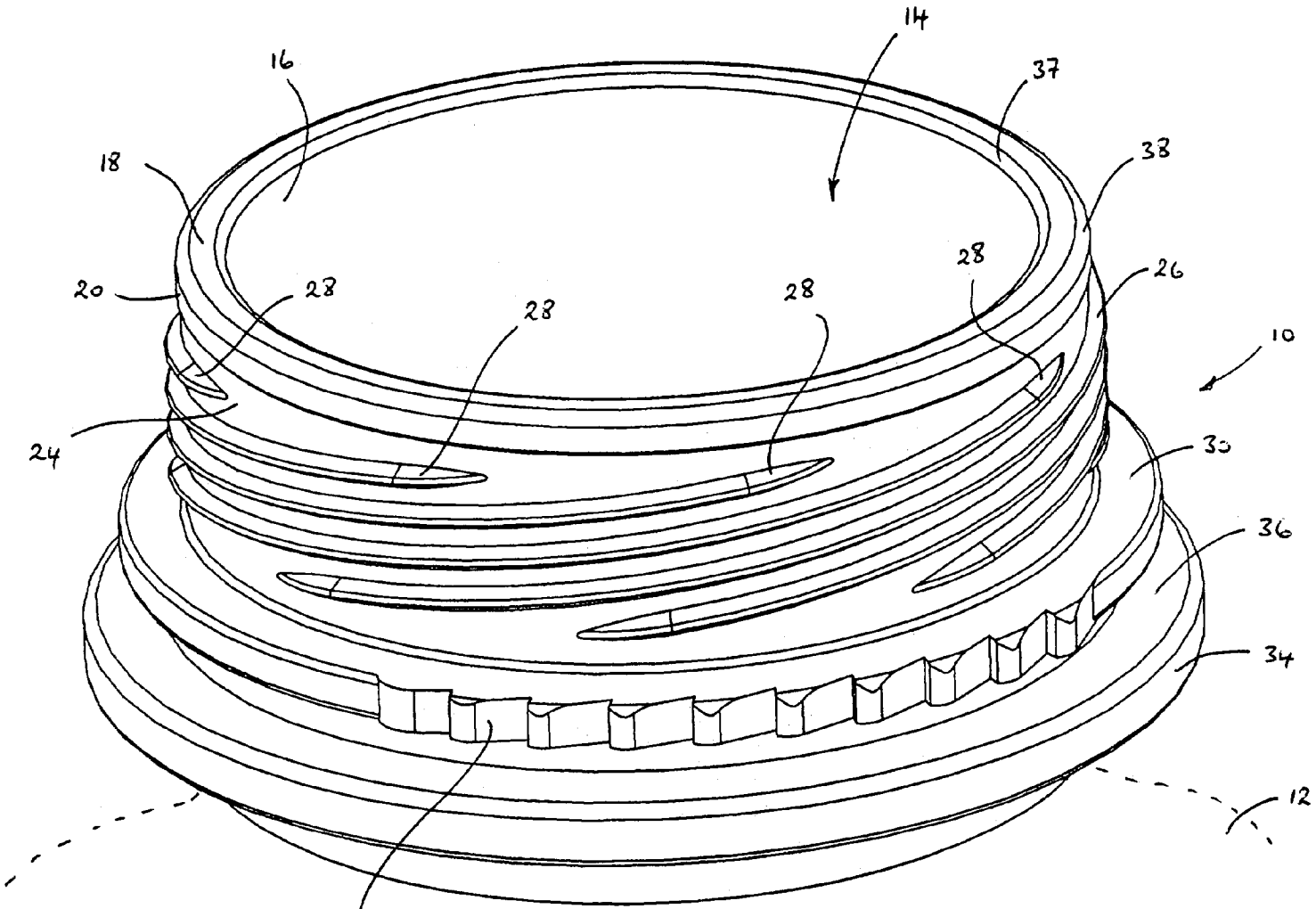
FIG. 1 is a perspective view of a container neck.
Figure 2:
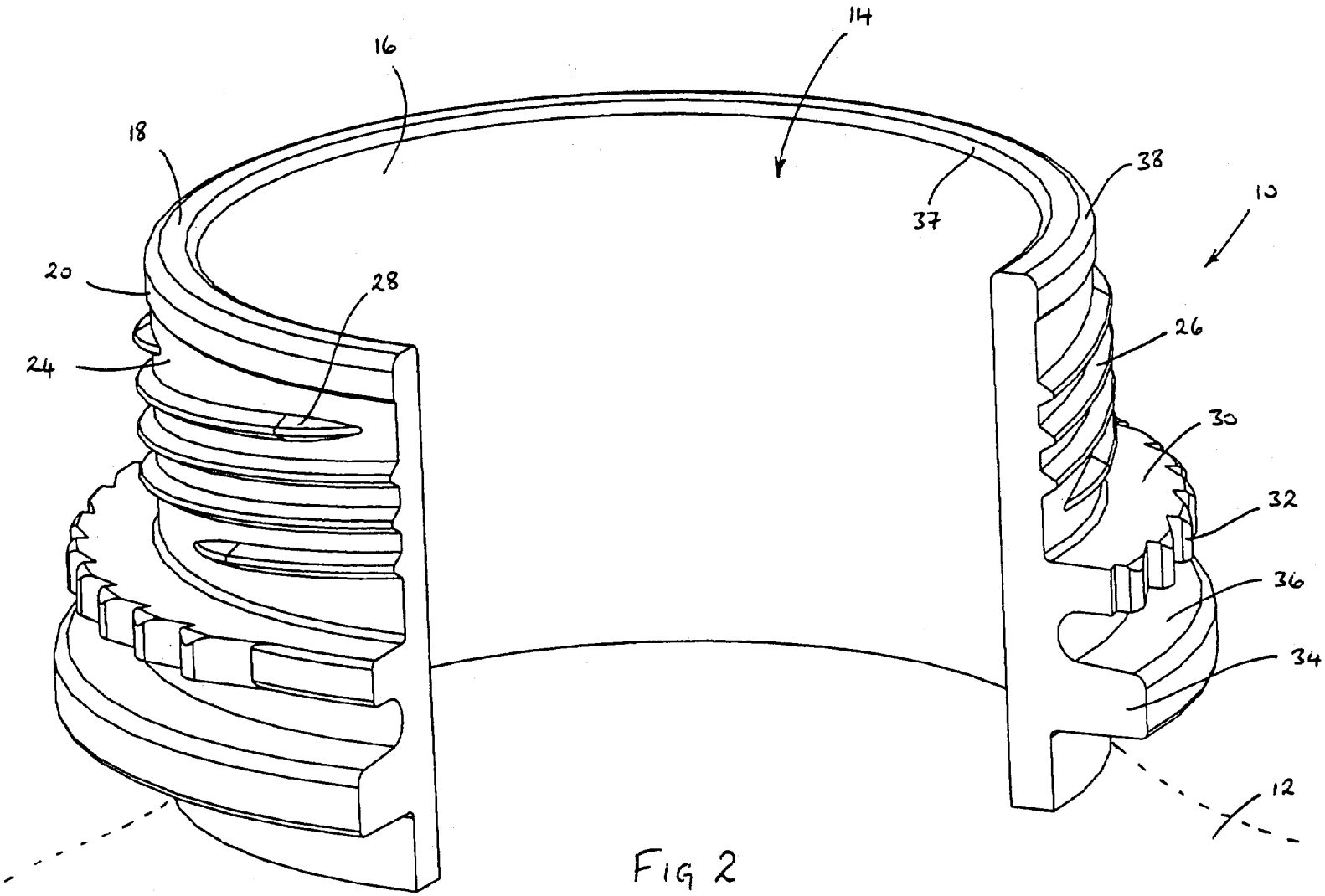
FIG. 2 is a perspective view of the container neck of FIG. 1 with part of the neck shown cut away.
Figure 3:
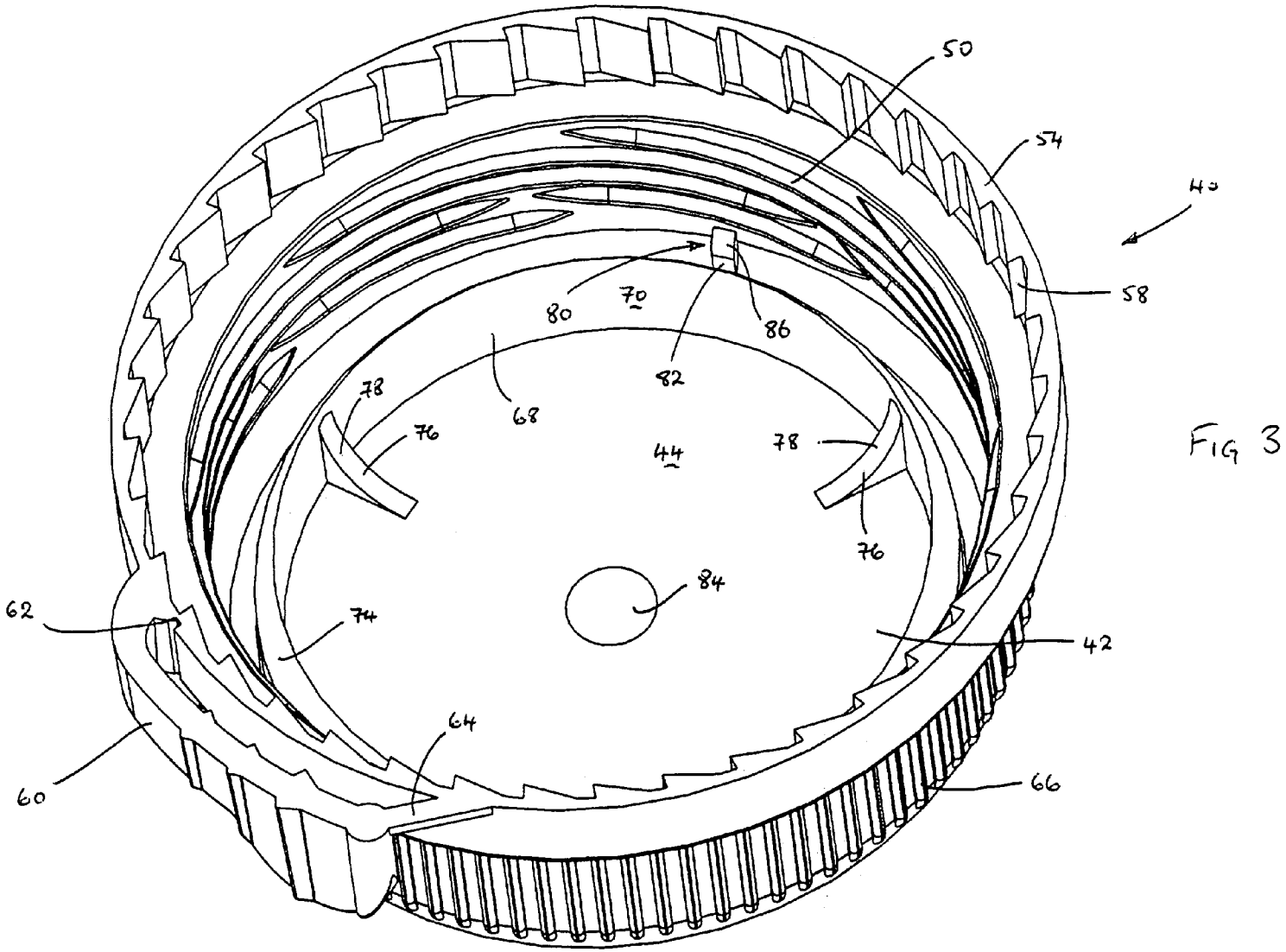
FIG. 3 is a perspective view of the underside of a cap for use with the container neck of FIGS. 1 and 2.
Figure 4:
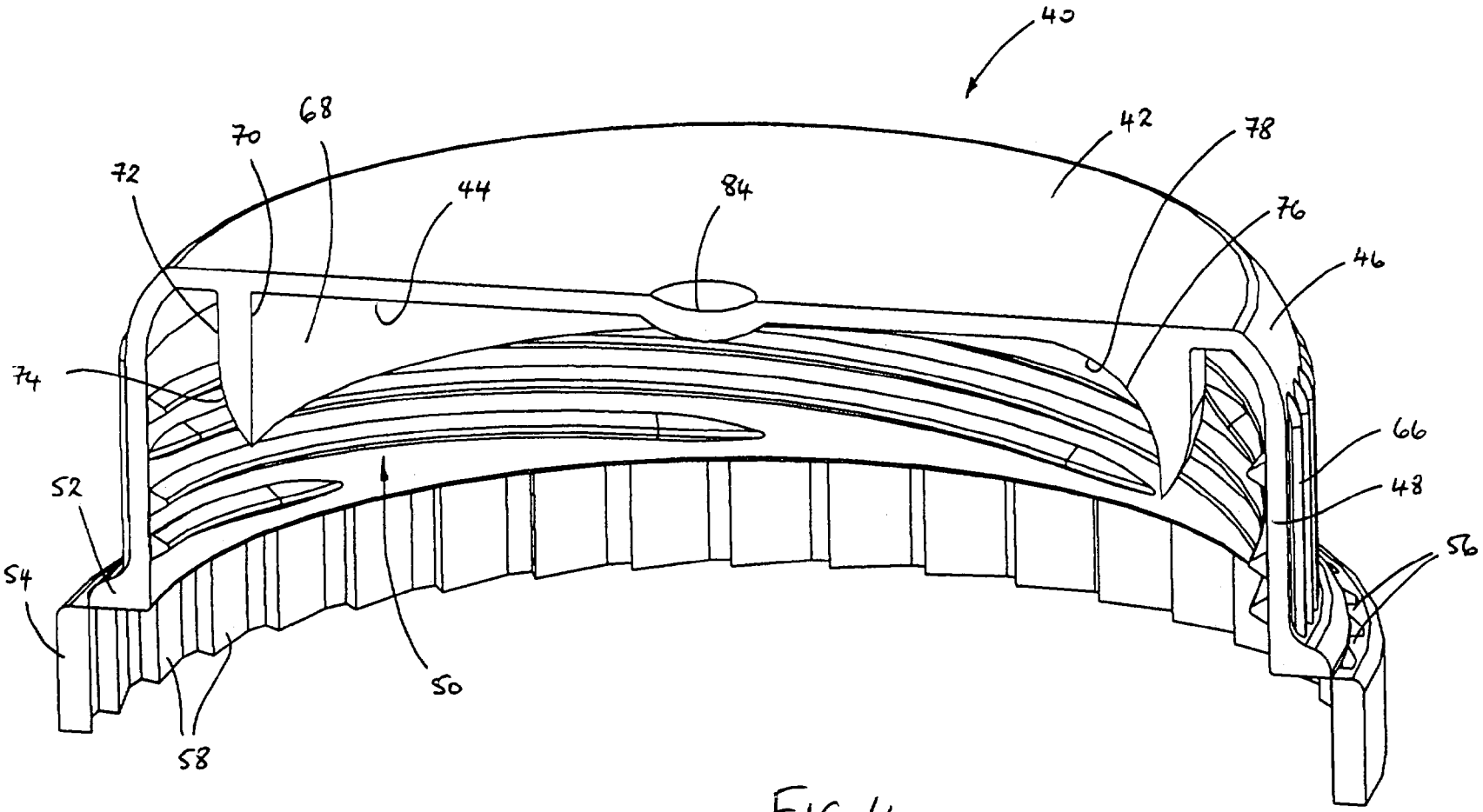
FIG. 4 is a cross-sectional view of the cap of FIG. 3 taken through one of the buttresses with which the annular plug is provided.
Figure 5:
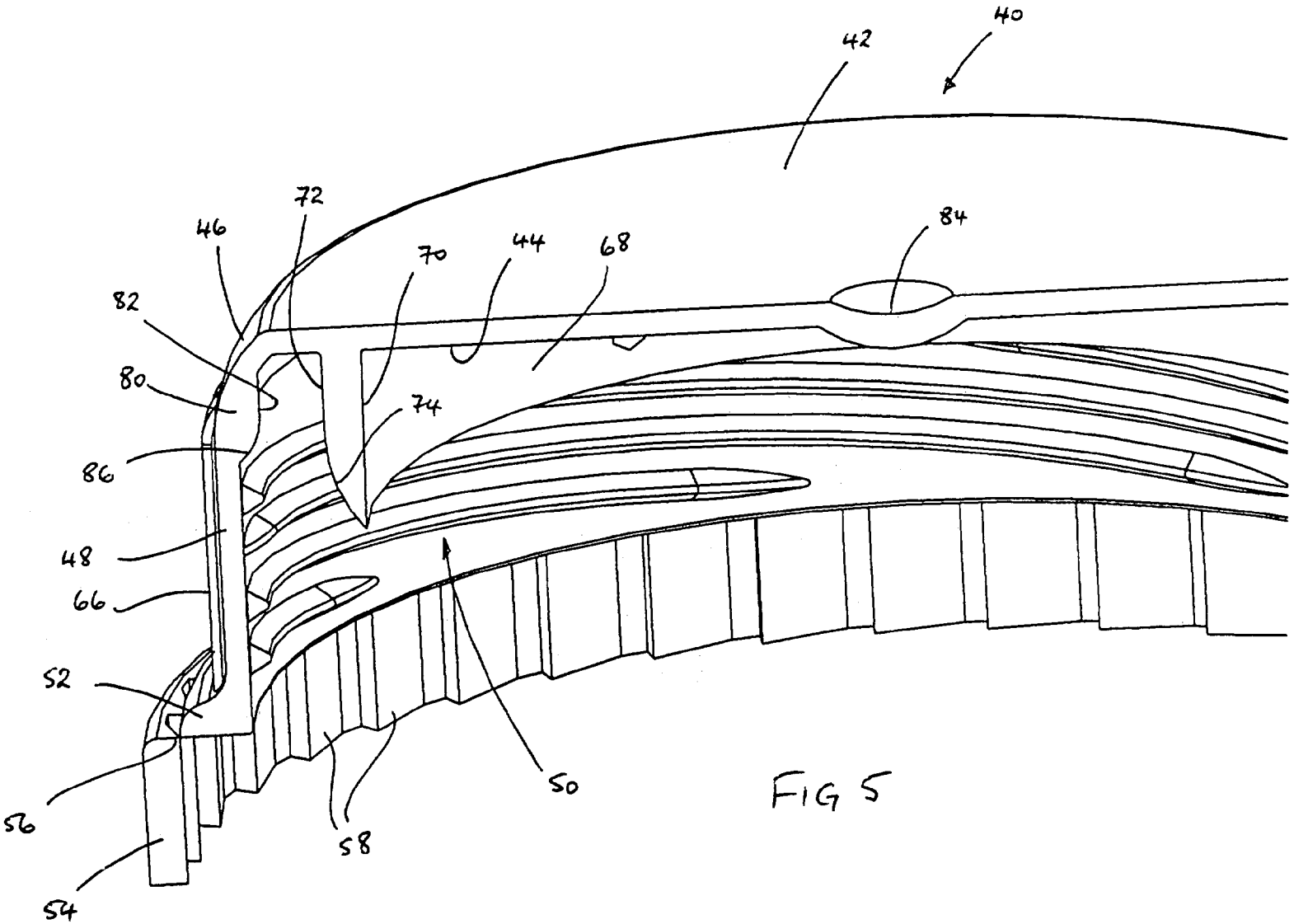
FIG. 5 is a cross-sectional view of the cap of FIG. 3 taken through one of the ribs formed on an internal surface of the downwardly extending skirt portion.
Figure 6:
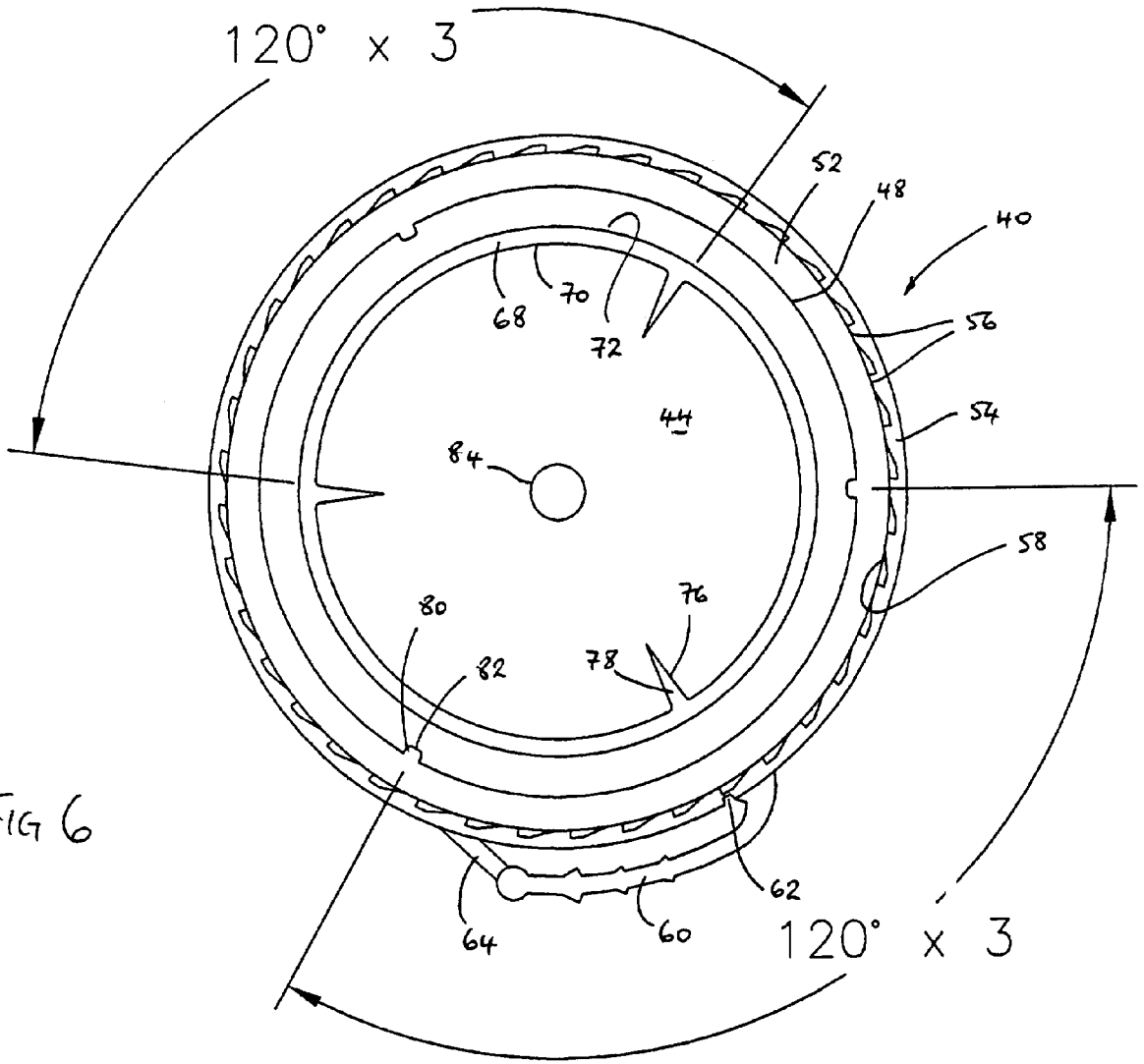
FIG. 6 is a plan view of the underside of the cap of FIG. 3.

Referring to FIGS. 1 and 2 there is shown a neck 10 of a container 12. The remainder of the container 12 has not been shown as its body shape may take any suitable form and may, for example, be of square, rectangular or circular cross-section and may have an integral handle formed as part of the body shape.

The neck 10 defines an opening 14 surrounded by a substantially smooth, cylindrical internal wall 16. A generally horizontal annular rim 18 merges with the internal wall 16 at an end remote from the body of the container 12 while, at a radially outer end, the rim 18 in turn merges with a depending external wall 20. Like the internal wall 16, external wall 20 is substantially smooth and cylindrical and forms what is known in the industry as an E-Wall.

The external wall 20 merges with a neck stretch portion 24 which is provided with engagement means with which to engage complimentary engagement means provided on a closure or cap. In the example shown, the engagement means provided on the neck stretch portion 24 take the form of a helical thread configuration 26 which includes seven threads or leads 28. It will be apparent however, that the engagement means may take a number of different forms and, in particular, may, if the complimentary engagement means provided on the cap takes the form of a helical thread configuration, comprise a helical groove configuration. Likewise, it will be apparent that the thread or groove configuration 26 need not be limited to seven threads or grooves but may comprise one, two or more threads or grooves as appropriate. Generally speaking however, it is preferable for the configuration to comprise several threads or grooves.

In the illustrated embodiment, each thread 28 extends about 120° about the circumference of the neck stretch portion 24. Once again however, it will be understood that threads of a lesser or greater extent may also be employed. For example, each thread 28 may extend within a range from 90° to more than 360°. If so desired, the threads or grooves may be interrupted at intervals along their length.

Preferably, the helical thread configuration 26 has a fine thread density to limit the vertical float of the cap on the neck 10. Thus, the thread density preferably lies within the range of between 12 and 20 threads per linear inch. Most preferably of all, is a thread density of approximately 17 or 18 threads per linear inch.

The neck stretch portion 24 terminates in a radially outwardly extending shoulder 30 which, at a radially outer edge, joins a further vertical neck stretch portion which is formed with a plurality of ratchet teeth 32. In the example shown, the ratchet teeth 32 are arranged in two groups of between 8 and 15 teeth each, although it will be appreciated the number and position of the teeth may be subject to considerable variation.

Below the ratchet teeth 32, the neck profile extends first radially inwardly and then radially outwardly to form a locking wall portion 34 which defines a generally horizontal surface 36 which is vertically spaced from, and extends generally parallel to, the shoulder 30. However, the locking wall portion 34 is dimensioned so as to have a slightly greater radial dimension than the shoulder 30 for reasons that will be explained below.

The cap 40 which engages the neck 10 is shown in FIGS. 3 to 6 and is formed of Linear Low Density Polyethelene (LLDPE) and includes a circular top 42 having an undersurface 44. The circular top 42 merges at a radially outer edge with a downwardly and radially outwardly inclined surface 46 which in turn merges with a depending annular side wall 48 to form a downwardly extending upper skirt portion. The depending annular side wall 48 is provided, on its inner surface, with complimentary engagement means for repeated and releasable engagement with the engagement means provided on the neck 10. As before, these engagement means may take many forms but, in the example shown, comprise a multi-lead, helical thread configuration 50 having seven threads or leads and a thread density of approximately 17 or 18 threads per linear inch. Once again, it will be appreciated that, if the engagement means provided on the neck 10 comprises a helical thread configuration, then the engagement means provided on the inner surface of the depending annular side wall 48 may comprise a helical groove configuration. In the embodiment shown each thread extends approximately 120° around the inner surface of the depending annular side wall 48. However, it is to be understood that this thread length may be increased or decreased if desired. For example, each thread may extend in a range from 90° to more than 360°. Likewise, the thread density is not intended to be limited to being about 17 or 18 threads per linear inch but, nevertheless, preferably lies within the range from about 12 to 20 threads per linear inch. Preferably, the thread configuration 26 on the neck 10 and the thread configuration 50 on the cap 40 each have at least two threads and a thread density of at least 12 threads per linear inch. If so desired the threads or grooves may be interrupted at intervals along their length.

The two thread configurations 24 and 50 may be shaped so as to slip past one another and engage when a direct, axial downward force is applied to the cap 40 urging the cap into engagement with the neck 10. In other words, when the cap 40 is pushed onto the neck 10, the threads on the cap 50 snap over and engage the threads on the neck 26. This may be made possible by appropriate shaping of the threads, for example, by forming the threads with an asymmetric cross-section or by making them less pronounced. Alternatively, if it is desired to rotate the cap 40 onto the neck 10, the threads may be of symmetrical as opposed to asymmetrical cross-section and may be more pronounced.

In the illustrated embodiment, the two thread configurations 26 and 50 each comprise multiple turns of thread so that a vertical line drawn across each thread configuration intersects three or four turns of thread depending upon the location of the line around the circumference of the neck stretch portion 24 or depending annular side wall 48. This ensures that when the cap 40 is applied to the neck 10 there will be multiple turns of thread engagement. Of course, the total cumulative thread engagement is subject to variation and, depending upon the linear thread density, may be as little as one turn of thread engagement or more than five turns of thread engagement.

Although optional, the cap shown in FIGS. 3 to 6 includes tamper evidencing means to alert the consumer to possible tampering with the contents of the container. To this end, at a region below the helical thread configuration 50, the depending annular side wall 48 merges with a generally radially outwardly directed shoulder 52 which in turn merges with a removable lower skirt portion 54. The lower skirt portion 54 is frangibly attached to a radially outer edge of the shoulder 52 by frangible means such as bridges 56. In an alternative arrangement, the bridges 56 may be replaced by a circumferential extending line of weakness or tear line or a combination of bridges and tear lines. The lower skirt portion 54 is provided on an inner surface with a plurality of ratchet teeth 58 which are complimentary to, and shaped to engage with, the ratchet teeth 32 provided on the neck 10. As shown in FIGS. 3 to 6, the ratchet teeth 58 may be joined directly to the generally radially outwardly directed shoulder 52 thereby forming the frangible bridges 56. However, it will be apparent that other configurations may also be used.

During the application of the cap 40 to the container neck 10, the ratchet teeth 58 pass over the helical thread configuration 26 provided on the neck (being of greater radial dimension) and slip between, and interengage with, the ratchet teeth 32. At the same time, the threads on the cap 50 snap over and engage the threads on the neck 26. Once in position, the mutual engagement of the ratchet teeth 32 and 58 prevents the cap 40 from being unscrewed from the neck 10 so long as the lower skirt portion 54 remains attached to the generally radially outwardly directed shoulder 52. Furthermore, because the undersurfaces of the ratchet teeth 58 rest on the horizontal surface 36 of the locking wall 34, it is not possible to prize the lower skirt portion 54 upwardly from underneath to disengage it from the ratchet teeth 32 whilst maintaining the lower skirt portion intact. Accordingly, in order to remove the cap, the lower skirt portion 54 must first be at least partially separated from the shoulder 52 and this may be accomplished by twisting the cap 40 relative to the neck 10 and breaking the frangible bridges 56. Alternatively, the lower skirt portion 54 may be removed before the cap is unscrewed by gripping a generally horizontal tear tab 60 provided on the lower skirt portion and pulling the lower skirt portion away from the generally radially outwardly directed shoulder 52. A vertically extending line of weakness 62 through the lower skirt portion 54 adjacent the tear tab 60 facilitates the removal of the lower skirt portion. At the same time a frangible web 64 serves to join an end of the tear tab 60 remote from the vertical line of weakness 62 to the lower skirt portion 54 thereby preventing the accidental snagging of the tear tab during handling of the cap and helping to keep the radial dimension of the cap to a minimum.

In order to facilitate the gripping of the cap 40 by a user both the downwardly and radially outwardly inclined surface 46 and the depending annular side wall 48 are provided on their outer surfaces with a plurality of circumferentially spaced, vertically extending ribs 66 which serve as knurls.

An annular plug 68 depends from the undersurface 44 of the circular top 42 and is spaced radially inwardly of the depending annular side wall 48. The annular plug 68 is defined by respective radially inner and outer walls 70 and 72, the radially outer plug wall 72 merging at an end remote from the circular top 42 with a generally downwardly and radially inwardly directed surface 74. This downwardly and radially inwardly directed surface 74 intersects the radially inner plug wall 70 and together serve to provide the annular plug 68 with a bevelled radially outer surface and a tapering cross-section. The annular plug 68 is reinforced by three circumferentially spaced buttresses 76 120° apart. Each buttress is located radially inwardly of the annular plug 68 and merges with both the undersurface 44 of the circular top 32 and with the radially inner plug wall 70, these two surfaces, in cross-section, defining the two orthogonal sides of a right angled triangle, the "hypotenuse" of which comprises an arcuate surface 78. Preferably this arcuate surface 78 is such that each buttress 76 represents a circular fillet having the largest radius of curvature permitted by the dimensions of the annular plug 68. In order to facilitate the moulding of the cap the buttresses 76 may have a substantially constant circumferential dimension substantially equal to that of the thickness of the annular plug 68 adjacent the circular top 42. Alternatively, the buttresses 76 may have a circumferential dimension that tapers towards the centre of the cap 40.

In addition, circumferentially spaced between the buttresses 76, the cap 40 is also provided with three downwardly extending ribs on the interior of the downwardly and radially outwardly inclined surface 46 close to where it merges with the circular top 42. Once again, these ribs 80 are spaced 120° apart and 60° apart from the buttresses 76. The ribs 80 define a smooth downwardly depending surface 82 before merging at an end remote from the circular top 42 with the inner surface of the depending annular side wall 48. As before, in order to facilitate the moulding of the cap 40, the three ribs 80 have a constant circumferential dimension which is approximately equal to that of the annular plug 68 adjacent the circular top 42.

As is common with a number of caps 40, a small downwardly directed dimple 84 is formed in the centre of the circular top 42 so that any flash left after the cap has been moulded does not project above the plane defined by the upper surface of the circular top 42.

In use, the cap 40 is applied to the container neck 10. As previously stated, initially this may be by means of a push-on application whereby the threads on the cap 50 snap over those provided on the neck 26 or else by means of a rotary application in which the cap 40 is threaded onto the neck 10 and the two thread configurations 26 and 50 interengage in the conventional manner. In any event, and in addition to the interengagement of the threads and ratchet teeth described earlier, it will be noted that, upon application of the cap 40 to the neck 10, the downwardly depending annular plug 68 provided on the undersurface of the circular top 42 is received within the opening 14 of the container neck 10. The reception of the annular plug 68 within the opening 14 is facilitated by the bevelled nature of the downwardly and radially inwardly directed surface 74 which typically is the first surface of the plug to engage the container neck and serves to guide the radially outer plug wall 72 into sealing engagement with the cylindrical internal wall 16. This process may be further facilitated by the provision of a radius 37 at the intersection of the cylindrical internal wall 16 and the annular rim 18.

Continued application of the cap 40 to the neck 10 brings the downwardly depending surface 82 of the ribs 80 into engagement with the external wall 20. Once again, this process may be further facilitated by providing a radius 38 at the intersection of the annular rim 18 and the external wall 20 or else by forming the ribs 80 so that the downwardly depending surface 82 merges with the depending annular side wall 48 by way of a smoothly curving, downwardly and radially outwardly directed surface 86. The engagement of the ribs 80 with the external wall 20 serves to increase the contact force between the radially outer plug wall 72 and the cylindrical inner wall 16 and so improve the sealing characteristics of the closure. At the same time the engagement of the ribs 80 with the external wall 20 serves to ensure that the annular plug 68 is located centrally with respect to the opening 14.

When the container 12 is used to package potable fluids such as fruit juices, the engagement of the radially outer plug wall 72 with the cylindrically internal wall 16 of the neck 10 is sufficient to seal the container and prevent leakage. However, if the container 12 is left in warm conditions so that the contents start to ferment, gas pressure builds up against the undersurface of the cap 40 causing the circular top 42 to dome upwards. As it does so the annular plug 68 flexes away from the cylindrical internal wall 16 of the container neck 10, pulled by the buttresses 76 as shown in FIGS. 7*b* and 8, creating a passage for the gas to escape between the radially outer plug wall 72 and the cylindrical internal wall 16. The fact that the radially outer plug wall 72 merges at an end remote from the undersurface of the circular top 44 with a downwardly and radially inwardly directed surface 74 facilitates this process since even in the absence of a pressure build up not all of the radially outer surface of the annular plug 68 is in contact with the cylindrical internal wall 16 of the neck 10.

In other words, the gas produced by the fermentation process causes an increase in pressure within the container and the doming of the circular top 42. By providing a small number of buttresses 76, the force exerted on the undersurface of the top 42 is transferred to discrete points on the annular plug 68 and is sufficient to pull the radially outer plug wall 72 out of engagement with the cylindrical internal wall 16. This allows the gas to get between the radially outer plug wall 72 and the cylindrical internal wall 16 and, once there, the presence of the gas serves to keep the annular plug 68 out of sealing engagement with the neck 10 until such time as the pressure within the container 12 has been at least partially alleviated. It will therefore be seen that the selection of the number of buttresses 76 is one way of controlling the pressure at which the plug seal opens. If the number of buttresses 76 were increased then, for a given gas pressure, the force transferred to the annular plug 68 by any particular one of the buttresses would be diminished and may not be sufficient to pull the radially outer plug wall 72 out of engagement with cylindrical internal wall 16. Accordingly, by increasing the number of buttresses the pressure at which the plug seal opens is increased. Conversely, reducing the number of buttresses is one way of lowering the pressure at which the plug seal opens.

Having escaped past the annular plug 68, the gas is free to escape to the atmosphere via the arcuate channels defined between the ribs 80. In closure systems having an E-Wall seal this would not be possible as the ribs would be replaced by an annular bead designed to engage the external wall 20 to form a secondary seal. By removing the annular bead and replacing it by three circumferentially spaced ribs 80, arcuate channels are created for gas to escape from the inside of the container through the interengaging helical thread configurations 26 and 50 and out from under the removable lower skirt portion 54 or else through the voids defined between the bridges 56 of the frangible connection between the radially outwardly directed shoulder 52 and the removable lower skirt portion 54.

Once the gas has escaped, the pressure build up within the container is alleviated. The circular top 42, which had previously been domed upwards, returns to its normal position with the radially outer plug wall 72 urged into sealing engagement with the cylindrical internal wall 16. This process is facilitated by the three buttresses 76 which add extra strength to the annular plug 68 and urge the plug into engagement with the neck 10 thereby sealing the container 12.

Thus, it will be apparent that there is described a closure system which incorporates a pressure release system capable of venting excess gas that might otherwise build up within the container as a result of, for example, the fermentation of the containers contents but which at the same time is capable of maintaining adequate sealing in everyday use.

Whilst the present invention has been described in relation to a container 12 having a neck 10, it will be apparent that the described closure is equally applicable to a neck fitment of the type used in conjunction with paperboard cartons to provide a neck structure.

Furthermore, while the present invention has been described in relation to the venting of excess gas caused as a result of the partial fermentation of the contents of the container, the invention is not limited to this use. In particular, it will be appreciated that if the container is sufficiently full the annular plug 68 may project into the contents. Under such circumstances, even if excess gas were to accumulate above the contents and cause the doming of the circular top 42, the excess gas pressure would not be able to be relieved without the escape of at least some of the contents. Accordingly the present invention is not limited simply to the venting of gas to relieve any excess pressure.

The invention claimed is:

1. A neck structure in combination with a closure, the neck structure defining a neck opening, a cylindrical sealing surface surrounding said neck opening, and a substantially cylindrical external neck surface, and the closure comprising a cap formed of resilient material having a top, a downwardly extending skirt portion depending from said top, an annual plug depending from an underside of said top, one or more buttresses spaced radially inwardly of said annular plug which merge with both said annular plug and with the underside of said top, and one or more ribs formed on an internal surface of said downwardly extending skirt portion, the annular plug and said one or more ribs being arranged concentrically and dimensioned such that, upon application of the cap to the neck structure, the annular plug projects into the neck opening and engages the cylindrical sealing surface and said one or more ribs engage said substantially cylindrical external neck surface, the annular plug being adapted to flex away from the cylindrical sealing surface pulled by said one or more buttresses upon the build up of excess pressure within the closure whereupon circumferentially spaced ends of each rib define therebetween a path for the venting of fluid to relieve said excess pressure.

2. The combination of claim 1, wherein the closure comprises a plurality of said ribs.

3. The combination of claim 2 wherein each of said ribs have a circumferential extent of less than 120°.

4. The combination of claim 2 wherein said ribs are circumferentially spaced at equal angles around said cap.

5. The combination of claim 1 comprising a plurality of said buttresses.

6. The combination of claim 5 wherein said buttresses have a circumferential extent of less than 30°.

7. The combination of claim 5 wherein said buttresses are circumferentially spaced at equal angles around said annular plug.

8. The combination of claim 5 wherein said buttresses are circumferentially spaced with respect to said ribs.

9. The combination of claim 8 wherein said buttresses and ribs alternate and are circumferentially spaced at equal angles around the cap.

10. The combination of claim 1 wherein said plug is provided at an end remote from the underside of said top with a radially outer beveled, radiused or chamfererd surface that extends generally downwardly and radially inwardly.

11. The combination of claim 1 wherein the cap is formed of plastics materials selected from the list comprising linear low density polyethelene, LDPE, MDPE, HDPE, or copolymer polypropylene.

12. The combination of claim 1 wherein the cap is provided on an internal surface of said downwardly extending skirt portion with engagement means with which to engage complimentary engagement means provided on the neck structure, said one or more ribs being formed on the internal surface of the downwardly extending skirt portion at a location intermediate said engagement means and said top.

13. The combination of claim 1 wherein the neck structure further defines a locking wall having an upper substantially horizontal surface, said closure further comprising a lower skirt portion having an undersurface, wherein said undersurface rests on said upper substantially horizontal surface when said closure is applied to said neck structure.

14. The combination of claim 13 wherein said lower skirt portion is a tamper-evidencing band frangibly connected to said downwardly extending skirt portion.

15. A closure for use with a neck structure, the closure comprising a cap formed of resilient material having a top, a downwardly extending skirt portion depending from said top, an annular plug depending from an underside of said top, a plurality of buttresses spaced radially inwardly from said annular plug which merge with both said annular plug and with the underside of said top such that said buttresses permit doming of said underside of said top and pull against said annular plug to cause flexing of said annular plug when said underside of said top domes, and one or more ribs formed on an internal surface of said downwardly extending skirt portion, said one or more ribs being arranged concentrically with the annular plug and circumferentially spaced ends of each rib defining an arcuate space therebetween, wherein said buttresses are circumferentially spaced with respect to said ribs, and wherein said buttresses and ribs alternate and are circumferentially spaced at equal angles around the cap.

16. The closure of claim 15, wherein the closure comprises a plurality of said ribs.

17. The closure of claim 16 wherein each of said ribs have a circumferential extent of less than 120°.

18. The closure of claim 16 wherein said ribs are circumferentially spaced at equal angles around said cap.

19. The closure of claim 15 wherein said buttresses have a circumferential extent of less than 30°.

20. The closure of claim 15 wherein said buttresses are circumferentially spaced at equal angles around said annular plug.

21. The closure of claim 15 wherein said plug is provided at an end remote from the underside of said top with a radially outer beveled, radiused or chamfererd surface that extends generally downwardly and radially inwardly.

22. The closure of claim 15 wherein the cap is formed of plastics materials selected from the list comprising linear low density polyethelene, LDPE, MDPE, HDPE or copolymer polypropylene.

23. The closure of claim 15 wherein the cap is provided on an internal surface of said downwardly extending skirt portion with engagement means with which to engage complimentary engagement means provided on the neck structure, said one or more ribs being formed on the internal surface of the downwardly extending skirt portion at a location intermediate said engagement means and said top.

* * * * *